US005559308A

United States Patent [19]

Hayashi

[11] Patent Number: 5,559,308

[45] Date of Patent: Sep. 24, 1996

[54] PERPENDICULARLY JOINED STRUCTURE WITH THIN-WALLED PLATES AND THIN-WALLED TUBES AND THE METHOD OF MANUFACTURE

[76] Inventor: Toshiomi Hayashi, 2-18-7 Omachi Nishi, Asaminami-ku, Hiroshima-shi, Hiroshima-ken, Japan

[21] Appl. No.: 269,006

[22] Filed: Jun. 30, 1994

[30] Foreign Application Priority Data

Jun. 30, 1993 [JP] Japan ..... 5-186793

[51] Int. Cl.[6] ..... F01N 1/08

[52] U.S. Cl. ..... 181/265; 181/272; 285/222

[58] Field of Search ..... 181/264, 265, 181/272, 282, 243; 285/405, 222

[56] References Cited

U.S. PATENT DOCUMENTS

| | | | |
|---|---|---|---|
| 2,011,433 | 8/1935 | Blagg et al. . | |
| 2,464,506 | 3/1949 | Hirschfeld . | |
| 3,786,730 | 1/1974 | Lunderholm . | |
| 3,794,363 | 2/1974 | Schulz . | |
| 4,192,531 | 3/1980 | Williams et al. | 285/222 |
| 4,212,099 | 7/1980 | Williams et al. . | |
| 4,558,892 | 12/1985 | Daw et al. . | |
| 4,576,247 | 3/1986 | Thorpe | 181/243 |
| 5,213,374 | 5/1993 | Keating . | |
| 5,415,443 | 5/1995 | Hayashi | 285/405 |
| 5,421,624 | 6/1995 | Hayashi et al. . | |
| 5,477,015 | 12/1995 | Preslicka et al. | 181/282 |

FOREIGN PATENT DOCUMENTS

| | | |
|---|---|---|
| 5039888 | 2/1993 | Japan . |
| 777493 | 6/1957 | United Kingdom . |

*Primary Examiner*—Khanh Dang
*Attorney, Agent, or Firm*—Lyon & Lyon

[57] ABSTRACT

A muffler designed at least about the exterior surface by a barrel with end plates. An inlet tube and an exhaust pipe are associated with the end plates, respectively. The external joints are formed by locked seamed roll joints and S-shaped deformed joints to avoid welding at the exterior of the muffler. Tubes extending between baffle plates may also employ the S-shaped deformed joints. Joint tubes having some ability to telescope axially with the other internal components provide thermal stress relief.

11 Claims, 6 Drawing Sheets

PERPENDICULARLY JOINED STRUCTURE WITH THIN-WALLED PLATES AND THIN-WALLED TUBES AND THE METHOD OF MANUFACTURE

BACKGROUND OF THE INVENTION

The field of the present invention is the construction of perpendicularly joined structures comprised of thin-walled plates and thin-walled tubes.

Typically, joint structures used in assembling thin-walled tubes and thin-walled plates have employed tapered tube joints or welded joints. With welded joints, either lap joints or the end of the thin-walled tube is flared or brazed joints are typically used. In the fabrication of mufflers where light weight and high vibration resistance are required, TIG auto welds are typically employed. Reference is made to FIG. 6 where thin-walled tubes 6 comprising an inlet tube $I_F$ and a funnel joint, tube $J_U$ are associated with a front end plate $C_F$. The barrel of the muffler is typically joined with the end plate using the joining method of a lock seamed roll joint S.

FIG. 7 illustrates another joint technique for a sheet and tubes. A collar 01 has a first flange 02 extending outwardly and a second flange 04 extending inwardly. These flanges 02 and 04 are spaced apart. The collar 01 is positioned over the end 05A of a tube 05. The flange area 04 extends over the end 05A. A sheet 06 with an appropriately sized hole therethrough may then be positioned over the end 05A of the pipe 05 and the collar 01 so as to be held by the flange 02. The flange 04 may then be deformed with the end 05A of the tube 05 by being flared outwardly to retain the sheet 06. A second tube may then be joined with the assembly.

It is also known to join a thin-walled tube with a thin-walled plate by providing a hole in the plate with a cylindrical flange extending perpendicularly thereto. A lip on the end of the cylindrical flange extends radially inwardly and a thin-walled tube extends through the flange to abut against the lip. The assembly is then flared such that the lip, the end of the tube and the cylindrical flange are forced outwardly. This operation locks the tube axially to the plate. To form an assembly, the other end of the tube of reduced diameter may be positioned in the opening of another such assembly and welded in place.

Certain of the foregoing practices are disadvantageous in the manufacture and performance of such thin-walled assemblies. The welding of such thin-walled members can develop strain. Further, anticorrosion characteristics may be lessened by the heat of welding. Additionally, more highly skilled labor is required and the environmental impact of welding is experienced. Using the technique employing the collar 01, additional components are required and the joint strength is not great. Sheer torque and vibration on such joints can result in a loosening of the joint with consequential losses in sealing.

SUMMARY OF THE INVENTION

The present invention is directed to the assembly of thin-walled tubes and plates for the creation of flow devices such as mufflers.

In a first, separate aspect of the present invention, thin-walled plates are prepared with circular grooves to receive the ends of thin-walled tubes. The plates and tubes are permanently retained by deformation of the grooves with the ends of the tubes. Other tubes telescope within the deformed plates and tube ends. Multiple plates may thus be assembled with appropriate placement of tubes with the plates being fixed in a surrounding housing. In this way, through sequential stamping, assembly and metal forming processes, with limited welding, such a thin-walled assembly can be constructed.

Such construction can reduce technical fabrication and assembly requirements and eliminate the adverse affects of welding, including thermal stress and loss of anticorrosion properties.

Accordingly, it is an object of the present invention to provide improved thin-walled plate and tube structures.

It is another object of the present invention to provide an improved method for the formation of thin-walled plate and tube structures.

Other and further objects and advantages will appear hereinafter.

DETAILED DESCRIPTION OF THE PREFERRED EMBODIMENT

Turning in detail to the drawings, the following symbols are applied to the drawings:

B: Muffler Barrel $C_R$: Rear End Plate

F: Front Resonance Chamber $I_F$: Inlet Tube

L: Loop Hole $M_T$: Muffler Tube Chamber

R: Reversing Chamber

T: Muffler Tube $C_F$: Front End Plate $E_R$: Exhaust Pipe

H: Helmholtz Chamber

J: Joint Tube

M: Muffler

P: Baffle Plates

S: Lock Seamed Roll Joint $U_R$: Tuning Tube a: Small Circular Groove b: Large Circular Groove

1: Large Diameter End Portion

2: Conical Flared Tube Portion

3: Flange Portion

4: S-Shaped Deformed Joint

5: Thin-Walled Plate

5*a*: Thin-Walled Plate Outer Perimeter

6: Thin-Walled Tube

6*a*: Thin-Walled Tube End Portion

7: Thin-Walled Tube Upper End Portion

8: Die

9: Punch

10: Plate/Tube Assy

12: Tube Front Smaller Diameter End Portion

13: Tube Rear Smaller Diameter End Portion

14: Plate/Tube Assy

15: Reversed Bend Area

16: Large Diameter Thin-Walled Tube

17: Weld Joint

Figure 3:
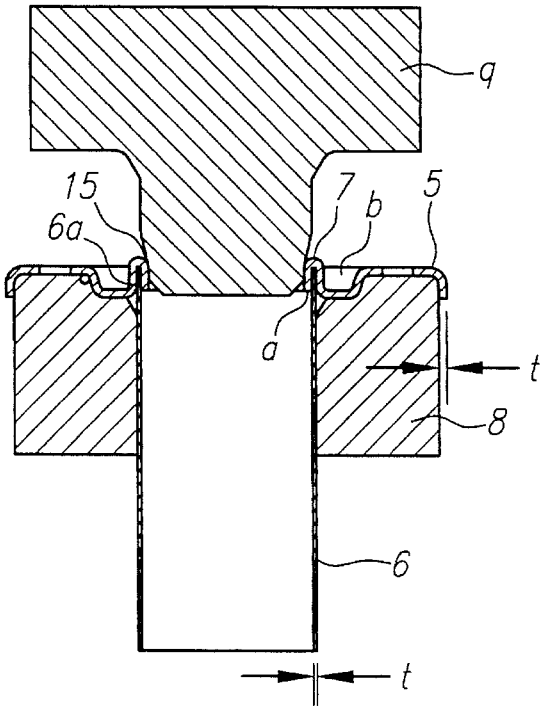
FIG. 3 is a cross-sectional elevation of a dye and punch initially deforming a coupling between a thin-walled tube and a thin-walled plate.
Figure 4:
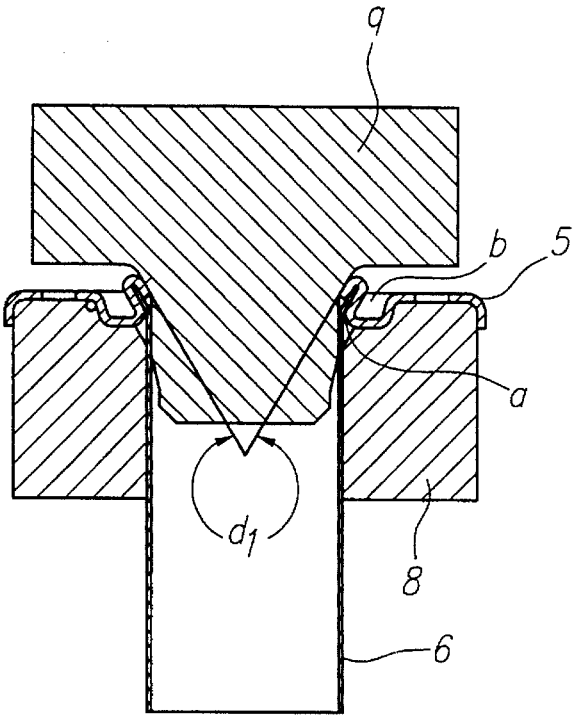
FIG. 4 is a cross-sectional elevation with the dye and punch of FIG. 3 further advanced.
Figure 5:
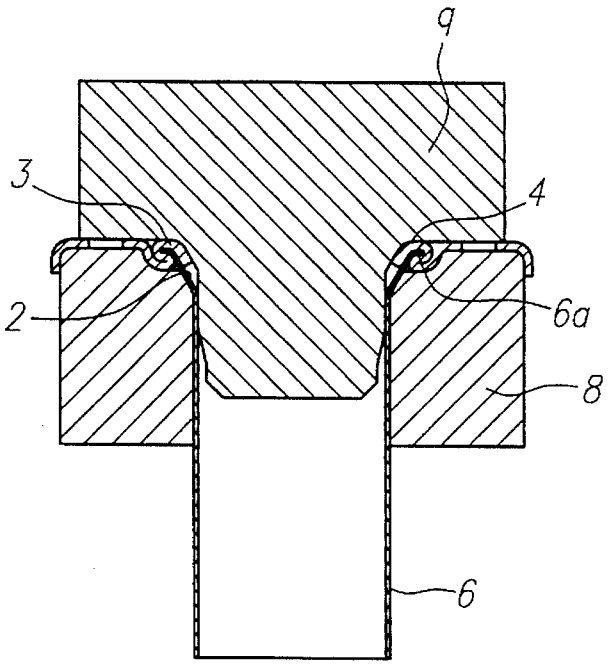
FIG. 5 is a cross-sectional elevation with the dye and punch of FIG. 3 fully advanced.
Figure 6:
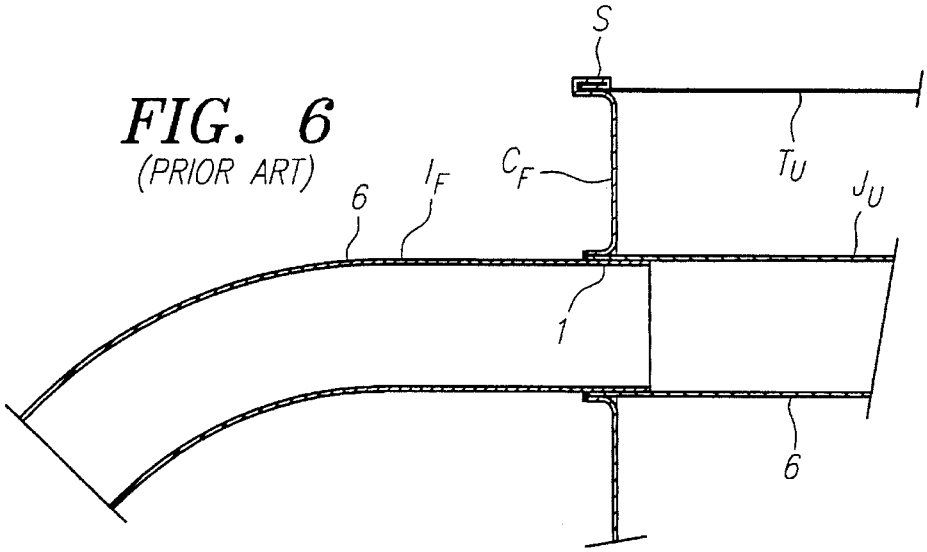
FIG. 6 (PRIOR ART)
FIG. 6 is a cross-sectional elevation of a prior art welded joint between a thin-walled tube and a thin-walled plate.
Figure 7A:
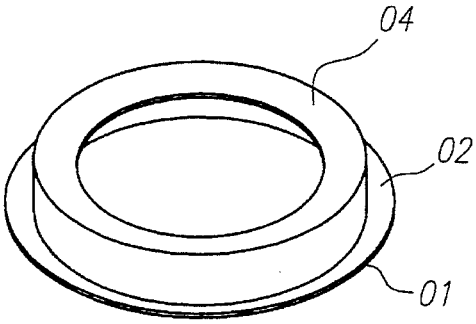
FIG. 7a (PRIOR ART)
FIG. 7 is a prior art joint between a thin-walled plate and thin-walled tube illustrating in perspective in FIG. (*a*) a collar in perspective, in FIG. (*b*) the collar in cross section, in FIG. (*c*) the collar, plate and tube positioned together in cross section and in FIG. (*d*) the collar, tube, plate and a second tube fully assembled in cross section.
Figure 7B:
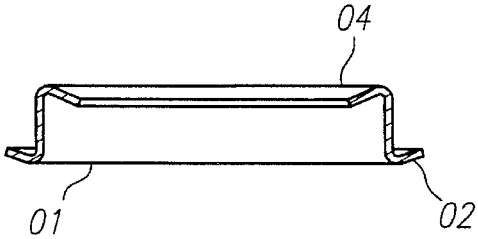
FIG. 7b (PRIOR ART)
Figure 7C:
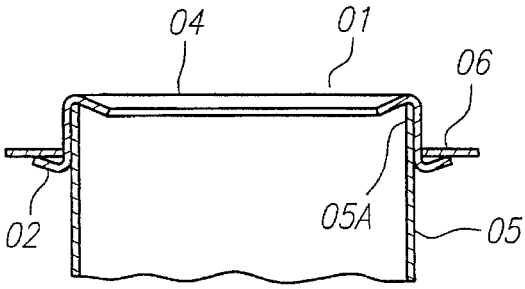
FIG. 7c (PRIOR ART)
Figure 7D:
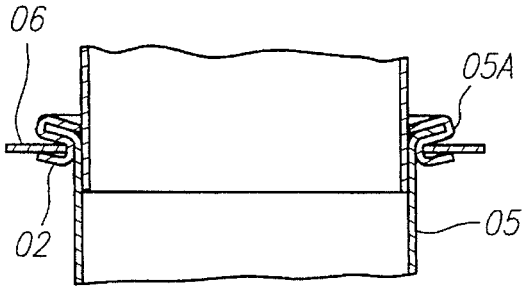
FIG. 7d (PRIOR ART)

A first experiment demonstrates the joint strength and anticorrosion characteristics of an S-shaped deformed joint. Thin-walled plate and tube joint specimens were prepared as shown in FIGS. 3 through 5. A thin-walled plate 5 having a flange with an outer diameter of 22 mm was press formed from 2.6 mm sheet coil 600 mm wide. This material is equivalent to SPHC per JIS G3131 hot rolled soft steel sheet and steel coil. The thin-walled plate 5 was formed to include a small diameter circular groove a which opens up in a first direction, downwardly as seen in FIG. 3. The groove a is defined by the folded plate 5 about a hole through the plate. The plate is corrugated such that a larger width circular groove b is provided on the other side of the plate from the groove a. A thin-walled tube 6 of 1.6 mm wall thickness is associated with the plate 5 in the groove a. The outer diameter of the end 7 is 50.8 mm and is made of material equivalent to STAM290GA per JIS G3472 automotive structure electric welding carbon steel pipe. The upper end 7 is press fit into the groove a.

The punch 8 and dye 9 are brought together with the plate 5 and tube 6 in place as shown. In FIG. 4, the punch 9 is shown to be advanced so as to deform the joint such that it is flared outwardly at an angle $\alpha_1$ as indicated in FIG. 4. $\alpha_1$ equals 70°. Further compression on the punch 9 defines the flanged area 3 of the tube 6 which becomes fixed in the groove a of the thin-walled plate 5. The corrugations of the plate defining the grooves a and b have now assumed an S-shape, retaining the flange 3. The conical flared tube portion 2 transitions between the flange 3 to the undeformed tube 6.

Thus formed as seen in FIG. 3 through 5, the joint 4 was mounted on a tester to establish displacement vs. load. The test specimen displayed a gently sloping curve beyond the elastic limit. Thus, no excessive yield phenomenon was found. Further, the joint 4 did not experience separation between the plate 5 and tube 6. Pull-out resistance reached 258.5–296.4 kgf (1.722–1.765 times the elastic limit). As the displacement reached 35–46 mm, the rate of increase in displacement with respect to the reduction of load became relatively large, and ultimately led to extreme plastic deformation at the end portion 6*a* of the tube 6 which caused it to partially separate away from the plate 5. From the test sample it was understood that the joint 4 provides a safe structure having sufficient strength as a fluid tight transfer joint with high pull-out resistance and the S-shaped joint 4.

A salt water spray fog-type corrosion test of the joint 4 having an S-shaped cross section was conducted with a thin-walled plate 5 having a flange with a 200 mm outer diameter. This was press formed from a 2.6 mm steel coil 600 mm wide equivalent to SUS410L per JIS G4305 cold rolled stainless steel sheet. The thin-walled tube 6 had a wall thickness of 1.6 mm and an outer diameter of 50.8 mm. The tube was of material equivalent to SUS410TK per JIS G3446 mechanical structure stainless steel pipe. It was determined that the joint 4 thus formed had a better anti-corrosion characteristic than existing welded joints.

Figure 1:
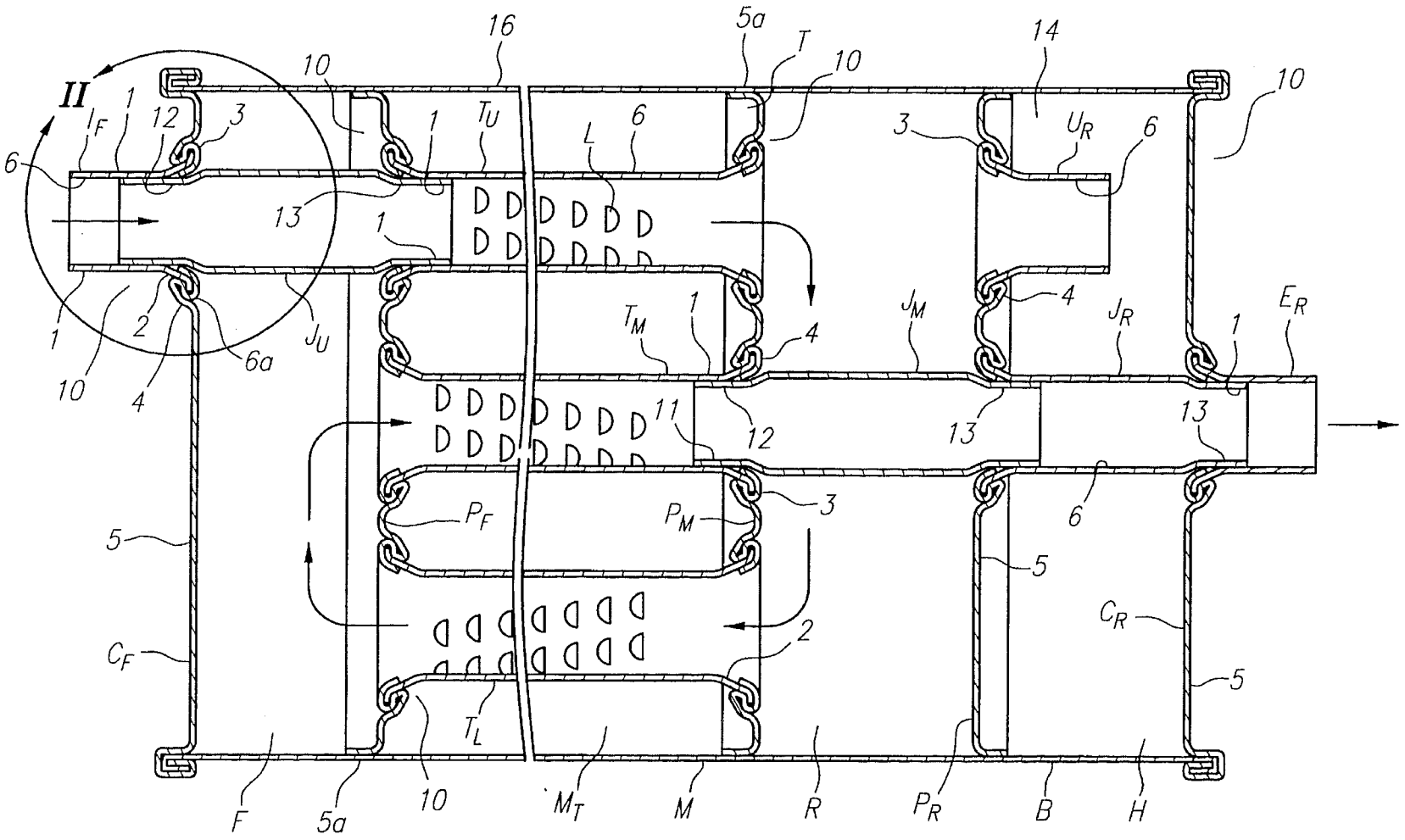
FIG. 1 is a vertical cross section showing a structure of the present invention as a muffler.
Figure 2:
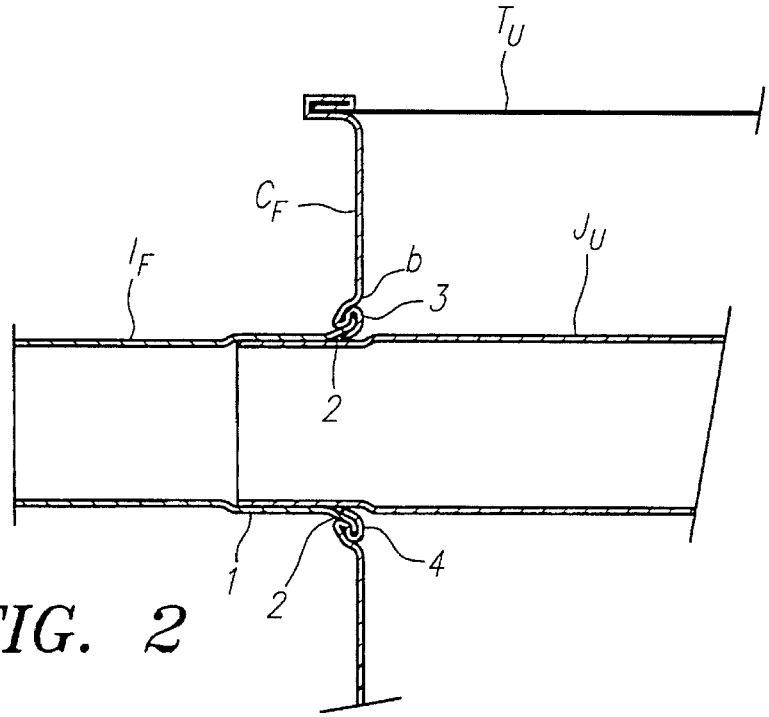
FIG. 2 is a detailed cross section taken from the region II of FIG. 1.

Turning to structures made using such joints 4, reference is made to the automotive muffler M of FIG. 1. FIG. 2 illustrates the detail of the inlet portion of the muffler. The muffler M has a front end plate $C_F$ and a rear end plate $C_R$. Each end plate $C_F$ and $C_R$ is press formed from 1.2 mm stainless steel sheet SUS436L corresponding to JIS G4305 cold rolled stainless steel sheet. A cylindrical shaped barrel B forms the muffler housing extending between the front and rear end plates.

Intermediate the front end plate $C_F$ and the rear end plate $C_R$ within the barrel B are a front baffle plate $P_F$, a central baffle plate $P_M$ and a rear baffle plate $P_R$. Each of these baffle plates P are of 1.00 mm sheet designed to divide the interior of the barrel B at appropriate distances.

An inlet tube $I_F$ extends to the front end plate $C_F$ where it is joined therewith by a tube and sheet joint 4. A joint tube $J_U$ extends from the inlet tube $I_F$ to a muffler tube $T_U$. The joint tube $J_U$ extends to the front baffle plate $P_F$ while the muffler tube $T_U$ extends between the front baffle plate $P_F$ and the central baffle plate $P_M$. Thus, the inlet tube $I_F$, the joint tube $J_U$ and the muffler tube $T_U$ define an inlet passage extending from outside the muffler through to the reversing chamber R between the central baffle plate $P_M$ and the rear baffle plate $P_R$. The joint tube $J_U$ is fabricated from 1.2 mm thick SUS 410TKA corresponding to JIS G3446 mechanical structure stainless steel pipe with an outer diameter of 50.8 mm with the diameter at both ends reduced.

An exhaust passageway is defined by a muffler tube $T_U$ extending between the front baffle plate $P_F$ and the central baffle plate $P_M$. A joint tube $J_M$ extends in communication with the muffler tube $T_M$ between the central baffle plate $P_M$ and the rear baffle plate $P_R$. A thin-walled tube $J_R$ extends from the joint tube $J_M$ to an exhaust pipe $E_R$. The exhaust pipe $E_R$ is joined with the rear end plate $C_R$ by means of a deformed joint 4. The muffler tube $T_M$ is shown coupled at both ends by deformed joints 4 to the front baffle plate $P_F$ and a central baffle plate $P_M$. The thin-walled tube $J_R$ is joined with the rear baffle plate $P_R$ by a deformed joint 4. The joint tube $J_M$ extends through both the central baffle plate $P_M$ and the rear baffle plate $P_R$ to communicate with the muffler tube $T_M$ and the thin-walled tube $J_R$ by a reduced diameter allowing the ends to telescope within the tubes. The thin-walled tube $J_R$ also has a reduced diameter at the rear end thereof to mate with the exhaust pipe $E_R$ through the rear end plate $C_R$ in a like manner.

A muffler tube $T_L$ extends between the front baffle plate $P_F$ and the central baffle plate $T_M$ in a like manner to that of the muffler tubes $T_U$ and $T_M$. Communication with a Helmholtz chamber H between the rear baffle plate $P_R$ and the rear end plate $C_R$ is accomplished by a thin-walled tube $U_R$ having a wall thickness of 1.2 mm and an outer diameter of 48.6 mm. The tube $U_R$ is joined with the rear baffle plate $P_R$ by means of a deformed joint 4.

But for the joint tubes $J_U$ and $J_M$, the free ends of the inlet tube $I_F$, the exhaust pipe $E_R$ and the tuning tube $U_R$ and one end of the tube $J_R$, all of the tube-to-plate joints are provided by the deformed joint 4 as illustrated in manufacture in FIGS. 3 through 5 and in some detail in FIG. 2. In each instance, a large diameter end portion 1 extends to a conical shaped flared area 2 which extends to an outwardly formed flange 3 for association with the S-shaped deformed corrugation in the several plates forming the deformed joint 4.

All of the associated components are retained by the deformed joints 4.

The plate/tube assemblies 10 and 14 having the large diameter end portions 1 receive the front and rear smaller diameter end portions 12 and 13 presented at both ends of the joint tubes $J_U$ and $J_M$ and at one end of the tube $J_R$ into certain of the muffler tubes T. A small clearance is provided at the end portions 12 and 13 in each instance.

To manufacture the muffler M, the plate/tube assemblies 10 and 14 are fabricated. These assemblies 10 and 14 are fabricated in accordance with the description as provided with regard to FIGS. 3, 4 and 5, above. Once the assemblies 10 and 14 are prepared, a first assembly, for example the assembly of the rear baffle plate $P_R$. The plate 5 is fixed about its periphery 5*a* in appropriate position in the axial direction of the large diameter thin-walled tube 16. The joint tube $J_M$ may then be positioned with the assembly of the front baffle plate $P_F$ and central baffle plate $P_M$ next being positioned. The plates 5 of the front baffle plate $P_F$ and the central baffle plate $P_M$ may also be fixed about their peripheries 5*a* to the large diameter thin-walled tube 16. The joint tube $J_U$ can then be positioned and lastly the end plates $C_F$ and $C_R$ can be positioned. A rolled joint providing a lock seams may then be provided about the periphery of the front and rear plates $C_F$ and $C_R$ for association with the large diameter thin-walled tube 16 of the barrel B.

In the muffler M of FIG. 1, the exhaust gas ejected from the engine flows to the muffler as shown by the arrows through the inlet tube $I_F$ where a portion of the flow may enter the muffler tube chamber $M_T$ via multiple loop holes L through the walls of the muffler tube $T_U$. The muffler tube chamber $M_T$ is located between the front baffle plate $P_F$ and the central baffle plate $P_M$. The remainder of the exhaust enters the reversing chamber R defined between the central baffle plate $P_M$ and the rear baffle plate $P_R$. The gas entering the reversing chamber R then flows backwardly through the muffler tube $T_L$ as indicated by the arrows. Again, loop holes L allow some flow radially through the tube wall. The gas passing fully through the muffler tube $T_L$ enters the front resonance chamber F. The flow again reverses into the exhaust tube defined by the muffler tube $T_M$, the joint tube $T_M$, the tube $T_R$ and the exhaust pipe $E_R$. The loop holes L through the muffler tube $T_M$ allow the exhaust from the muffler tube chamber $M_T$ to exit through the exhaust tube.

The flow path of the exhaust gas within the muffler M as explained above causes the pulsating pressure of exhaust gas to drop as a result of resistances through the various flow paths. Also, adiabatically expanded exhaust gas within the reversing chamber R is discharged to the outside from the exhaust pipe $E_R$ after pressure pulses have been damped out by counteracting resonance between the tuning tube $U_R$ and the Helmholtz chamber H.

Through use, each portion of the muffler equipment is expected to be exposed to extreme temperature change and pressure variation. The entire outer components including the barrel, the front end plate $C_F$ and the rear end plate $C_R$ as well as the inlet tube $I_F$ and the exhaust pipe $E_R$ are not assembled by welding. Spot welding may be employed, where appropriate, to retain the baffle plates. Further, the joint tubes $J_U$ and $J_M$ as well as the tube $J_R$ are able to accommodate variations in thermal load by telescoping into and out of the associated tubes. Consequently, thermal stresses are minimized and the lowered anticorrosion effect of welds is avoided. Finally, gas-tight welding operations requiring skilled technicians are avoided.

Figure 8:
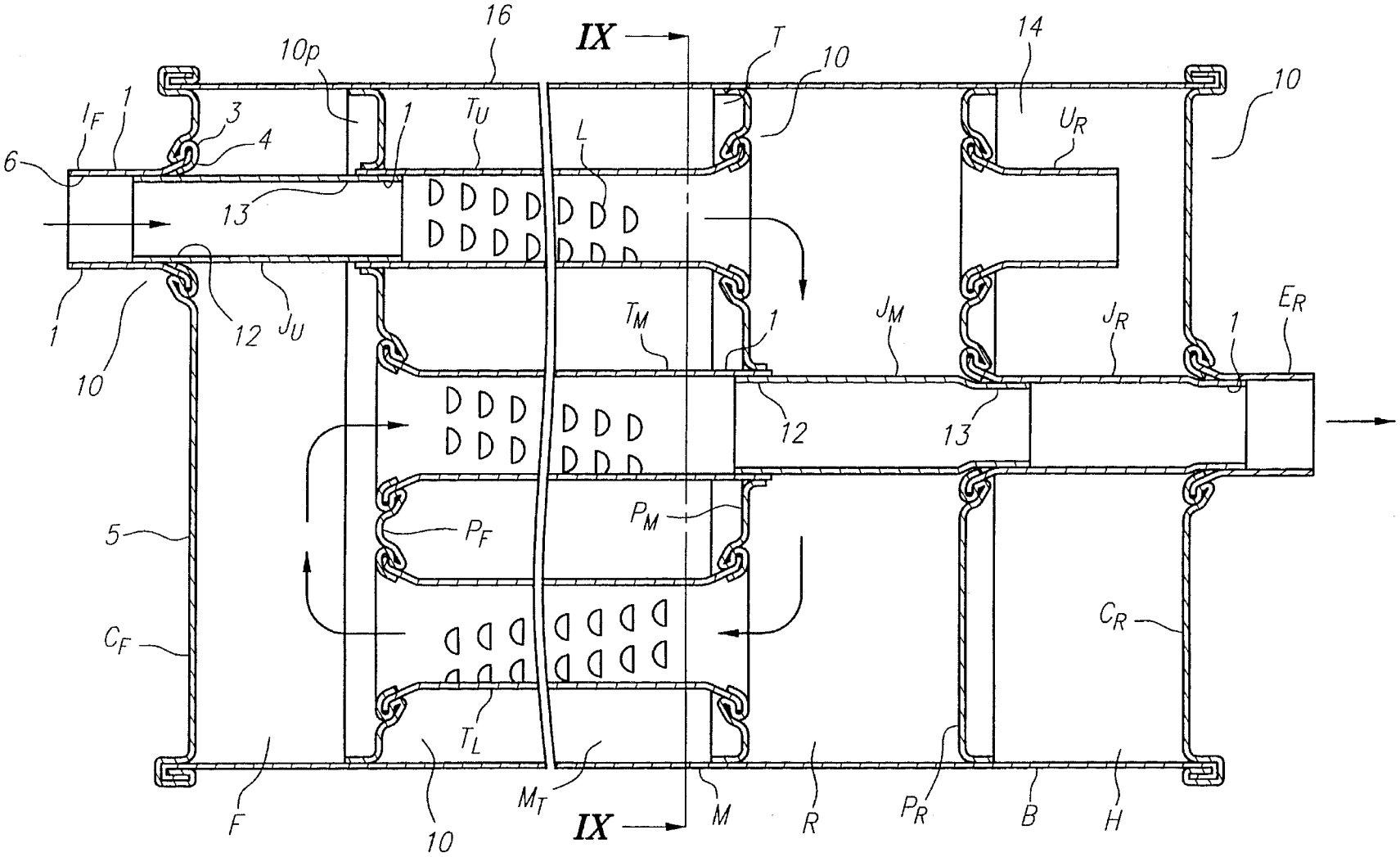
FIG. 8 is a second embodiment of a structure of the present invention defining a muffler.
Figure 9:
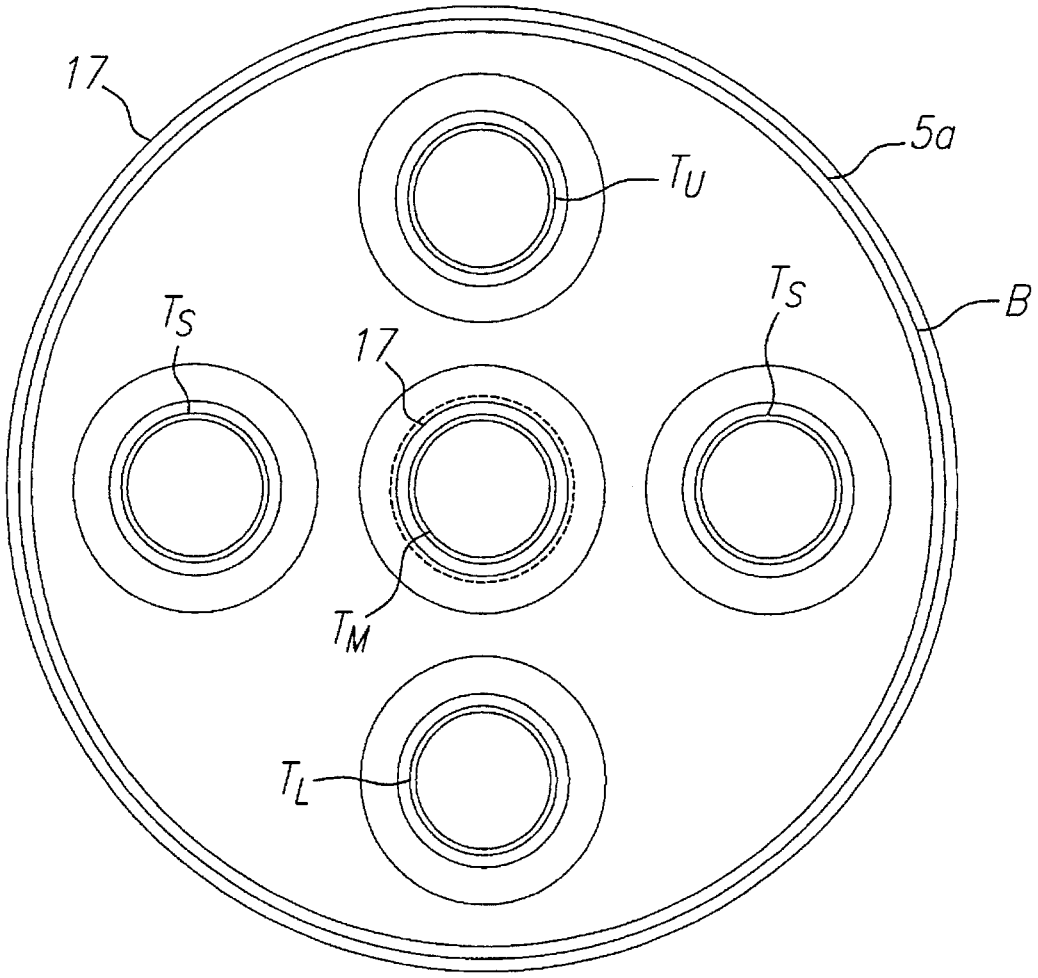
FIG. 9 is a cross-sectional view taken along line IX—IX of FIG. 8.

Looking next to the embodiment of FIGS. 8 and 9, the front plate/tube assembly 10 is manufactured using the S-shaped deformed joint 4 to associate the inlet tube $I_F$ with the front end plate $C_F$. The tube $I_F$ is a 1.2 mm wall thickness JIS G3472 automotive structure electric resistance weld carbon steel tube having an outer diameter of 50.8 mm. The end plate $D_F$ has an approximate 230 mm outer diameter and is comprised of 1.6 mm wall thickness JIS G3113 automotive structure hot rolled steel sheet SAPH32. The exhaust pipe $E_R$ of equal material to the inlet tube $I_F$ is associated with the rear end plate $C_R$ also of equal structure to the front plate $C_F$ by means of an S-shaped deformed joint 4. Thus, the outside of the muffler M has an assembly as in the previous embodiment. Internally, some spot welding is employed. Four spot welds are provided at each of the intersection of the joint tube $J_U$ with the muffler tube $T_U$ and the joint tube $J_M$ with the muffler tube $T_M$. The spot welds in this embodiment are identified as 17. Another change over the first embodiment is found in the fabrication of the tuning tube $U_R$ as using the same material as the inlet tube $I_F$. Further, the barrel is fabricated from JISG3113 automotive structure hot rolled steel sheet corresponding to SAPH32. The remaining features are the same.

Thus, improved muffler construction is defined by the foregoing embodiments. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A structure comprising a large diameter thin-walled tube;

thin-walled plates positioned within and across the large diameter thin-walled tube and spaced one from another;

thin-walled tubes positioned perpendicular to the thin-walled plates, a first tube of the thin-walled tubes being joined with a first plate of the thin-walled plates, the first plate having a first hole therethrough and a first circular groove about the first hole, the first tube being held together with the first plate in the first circular groove with the first circular groove deformed, a second tube of the thin-walled tubes being joined with a second plate of the thin-walled plates, the second plate having a second hole therethrough and a second circular groove about the hole, the second tube being held together with the second plate in the second circular groove with the second circular groove deformed;

a joint tube extending between the first plate and the second plate, the joint tube having an outside diameter at each end thereof to allow telescoping into the first tube and the second tube where the first tube and the second tube are held with the first plate and the second plate, respectively, at least the first plate being fixed to the large diameter thin-walled tube.

2. The structure of claim 1, the length of the joint tube being longer than the distance between the first plate and the second plate when assembled.

3. The structure of claim 1, the first thin-walled tube being an inlet tube, a third tube of the thin-walled tubes being an outlet tube held together with a third plate of the thin-walled plates.

4. A structure comprising a large diameter thin-walled tube;

thin-walled plates positioned within and across the large diameter thin-walled tube and spaced one from another;

thin-walled tubes positioned perpendicular to the thin-walled plates, a first tube of the thin-walled tubes being joined with a first plate of the thin-walled plates, the first plate having a first hole therethrough with a first circular groove about the first hole, the first tube being held together with the first plate in the first circular groove with the first circular groove deformed, a second tube of the thin-walled tubes being joined with a second plate of the thin-walled plates, the second plate having a second hole therethrough with a second circular groove about the second hole, the second tube being held together with the second plate in the second circular groove with the second circular groove deformed, the second tube of the thin-walled tubes being joined with a third plate of the thin-walled plates, the third plate having a third hole therethrough with a third circular groove about the third hole, the second tube being held together with the third plate in the third circular groove with the third circular groove deformed, a third tube of the thin-walled tubes being joined with the second plate of the thin-walled plates, the second plate having a fourth hole therethrough with a fourth circular groove about the fourth hole, the third tube being held together with the second plate in the fourth circular groove with the fourth circular groove deformed, the third tube of the thin-walled tubes being joined with the third plate of the thin-walled plates, the third plate having a fifth hole therethrough with a fifth circular groove about the fifth hole, the third tube being held together with the third plate in the fifth circular groove with the fifth circular groove deformed, a fourth tube of the thin-walled tubes being held together with a fourth plate of the thin-walled plates, the fourth plate having a sixth hole therethrough with a sixth circular groove about the sixth hole, the fourth tube being held together with the fourth plate in the sixth circular groove with the sixth circular groove deformed;

joint tubes positioned perpendicular to the thin-walled plates, a first joint tube extending between the first plate and the second plate, the first joint tube telescoping into the first tube and the second tube where the first tube and the second tube are held with the first plate and the second plate, respectively, a second joint tube extending between the third plate and the fourth plate, the second joint tube telescoping into the third tube and the fourth tube where the third tube and the fourth tube are held with the third plate and the fourth plate, respectively, at least the first plate being fixed to the large diameter thin-walled tube.

5. The structure of claim 4, a fifth tube of the thin-walled tubes being joined with the second plate of the thin-walled plates, the second plate having a seventh hole therethrough with a seventh circular groove about the seventh hole, the fifth tube being held together with the second plate in the seventh circular groove with the seventh circular groove deformed, the fifth tube of the thin-walled tubes being joined with the third plate of the thin-walled plates, the third plate having a eighth hole therethrough with a eighth circular groove about the eighth hole, the third tube being held together with the third plate in the eighth circular groove with the eighth circular groove deformed.

6. The structure of claim 5, the second tube, the third tube and the fifth tube having holes laterally therethrough.

7. The structure of claim 4, a fifth tube of the thin-walled tubes being held together with a fifth plate of the thin-walled plates, the fourth tube of the thin-walled tubes extending between the fourth plate and the fifth plate and telescoping into the fifth tube where the fifth tube is held with the fifth plate, the fifth plate being fixed to the large diameter thin-walled tube.

8. A structure comprising a large diameter thin-walled tube;

thin-walled plates positioned within and across the large diameter thin-walled tube and spaced one from another;

thin-walled tubes positioned perpendicular to the thin-walled plates, a first tube of the thin-walled tubes being joined with a first plate of the thin-walled plates, the first plate having a first hole therethrough with a first circular groove about the first hole, the first tube being held together with the first plate in the first circular groove with the first circular groove deformed, a second tube of the thin-walled tubes extending to a second plate of the thin-walled plates, the second plate having a second hole therethrough, the second tube extending into the second hole, the second tube of the thin-walled tubes being joined with a third plate of the thin-walled plates, the third plate having a third hole therethrough with a second circular groove about the third hole, the second tube being held together with the third plate in the second circular groove with the second circular groove deformed, a third tube of the thin-walled tubes being joined with the second plate of the thin-walled plates, the second plate having a fourth hole therethrough with a third circular groove about the fourth hole, the third tube being held together with the second plate in the third circular groove with the third circular groove deformed, the third tube of the thin-walled tubes extending to the third plate of the thin-walled plates, the third plate having a fifth hole therethrough, the third tube extending into the fifth hole, a fourth tube of the thin-walled tubes being held together with a fourth plate of the thin-walled plates, the fourth plate having a sixth hole therethrough with a fourth circular groove about the sixth hole, the fourth tube being held together with the fourth plate in the fourth circular groove with the fourth circular groove deformed;

joint tubes positioned perpendicular to the thin-walled plates, a first joint tube extending between and telescoping into the first tube and the second tube where the first tube and the second tube are at the first plate and the second plate, respectively, a second joint tube extending between and telescoping into the third tube and the fourth tube where the third tube and the fourth tube are at the third plate and the fourth plate, respectively, at least the first plate being fixed to the large diameter thin-walled tube.

9. The structure of claim 8, a fifth tube of the thin-walled tubes extending to the second plate of the thin-walled plates, the second plate having a seventh hole therethrough, the fifth tube extending into the seventh hole, the fifth tube of the thin-walled tubes being joined with the third plate of the thin-walled plates, the third plate having an eighth hole therethrough, the fifth tube extending into the eighth hole.

10. The structure of claim 9, the second tube, the third tube and the fifth tube having holes laterally therethrough.

11. The structure of claim 8, a fifth tube of the thin-walled tubes being held together with a fifth plate of the thin-walled plates, the fourth tube of the thin-walled tubes extending between the fourth plate and the fifth plate and having one end thereof telescoping into the fifth tube where the fifth tube is held with the fifth plate, the fifth plate being fixed to the large diameter thin-walled tube.

* * * * *